US009573362B2

(12) United States Patent
Ono et al.

(10) Patent No.: US 9,573,362 B2
(45) Date of Patent: Feb. 21, 2017

(54) INK JET HEAD AND INK JET PRINTER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Shunichi Ono, Shizuoka (JP); Noboru Nitta, Shizuoka (JP); Teruyuki Hiyoshi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/814,806

(22) Filed: Jul. 31, 2015

(65) Prior Publication Data

US 2016/0067958 A1 Mar. 10, 2016

(30) Foreign Application Priority Data

Sep. 5, 2014 (JP) ..... 2014-181667

(51) Int. Cl.
*B41J 2/045* (2006.01)

(52) U.S. Cl.
CPC ..... *B41J 2/04501* (2013.01); *B41J 2/04528* (2013.01); *B41J 2/04543* (2013.01); *B41J 2/04551* (2013.01); *B41J 2/04581* (2013.01)

(58) Field of Classification Search
CPC ..... G06F 3/12; B41J 2/04501
See application file for complete search history.

(56) References Cited

U.S. PATENT DOCUMENTS 5,600,354 A * 2/1997 Hackleman ..... B41J 2/14024 347/50
5,899,614 A * 5/1999 Maeda ..... G06F 3/1296 400/62
2002/0005960 A1* 1/2002 Yada ..... G06K 15/00 358/1.1
2004/0021709 A1* 2/2004 Hayasaki ..... B41J 2/04525 347/5
2011/0012948 A1* 1/2011 Kurashina ..... B41J 2/04541 347/10
2015/0151536 A1* 6/2015 Ono ..... G06K 15/10 347/9

FOREIGN PATENT DOCUMENTS

JP 2013-014130 1/2013

* cited by examiner

*Primary Examiner* — Shelby Fidler
(74) *Attorney, Agent, or Firm* — Amin, Turocy & Watson LLP

(57) ABSTRACT

According to one embodiment, an ink jet head includes a discharge section, a control section that has a first receiving section, a setting section, a second receiving section, and a determination section, and a voltage applying section. The first receiving section receives setting data for setting a command code value corresponding to a command. The setting section sets the command code value with respect to the command based on the setting data received by the first receiving section. The second receiving section receives command data including the command code value. The determination section determines the command indicated by the command code value included in the command data that is received by the second receiving section based on the command code value set by the setting section. The voltage applying section applies a voltage to the actuator based on the command that is determined by the determination section.

6 Claims, 6 Drawing Sheets

FIG. 4

| | | | COMMAND CODE VALUE | |
|---|---|---|---|---|
| | REGISTER | TYPE OF COMMAND | SETTING VALUE | INITIAL VALUE |
| INDEX | R0 | | | |
| COMMAND VALUE SETTING AREA | R1 | COMMAND-IN | "R1 SETTING VALUE" h | 01 |
| | R2 | FIRST LINE | "R2 SETTING VALUE" h | |
| | R3 | PRINTING·INITIAL | "R3 SETTING VALUE" h | |
| | R4 | PRINTING | "R4 SETTING VALUE" h | |
| | R5 | HEAT·INITIAL | "R5 SETTING VALUE" h | |
| | R6 | HEAT | "R6 SETTING VALUE" h | |
| GENERATED WAVEFORM SETTING AREA | ⋮ | | | |
| | R252 | | | |
| | R253 | | | |
| | R254 | | | |
| | R255 | | | |

INK JET HEAD AND INK JET PRINTER

CROSS-REFERENCE TO RELATED APPLICATION

This application is based upon and claims the benefit of priority from Japanese Patent Application No. 2014-181667, filed Sep. 5, 2014, the entire contents of which are incorporated herein by reference.

FIELD

Embodiments described herein relate generally to an ink jet head and an ink jet printer.

BACKGROUND

A control circuit such as IC for controlling the drive of an ink jet head detects reception of a start bit command containing a command code value as a signal of starting data transfer. The control circuit detecting the reception of the start bit command operates according to a command corresponding to the command code value. In the control circuit of the related art, there is a problem that the command code value is fixed.

DESCRIPTION OF THE DRAWINGS

FIG. 4 is a diagram illustrating a relationship between a command and a setting value according to the embodiment.

DETAILED DESCRIPTION

In order to solve the problem described above, an ink jet head is provided to eliminate a drawback in which a command code value is fixed.

In general, according to one embodiment, an ink jet head includes a discharge section, a control section that has a first receiving section, a setting section, a second receiving section, and a determination section, and a voltage applying section. The discharge section discharges ink by an operation of an actuator. The first receiving section receives setting data for setting a command code value corresponding to a command. The setting section sets the command code value with respect to the command based on the setting data received by the first receiving section. The second receiving section receives command data including the command code value. The determination section determines the command indicated by the command code value included in the command data that is received by the second receiving section based on the command code value set by the setting section. The voltage applying section applies a voltage to the actuator of the discharge section based on the command that is determined by the determination section.

Hereinafter, an embodiment will be described with reference to the drawings.

Figure 1:
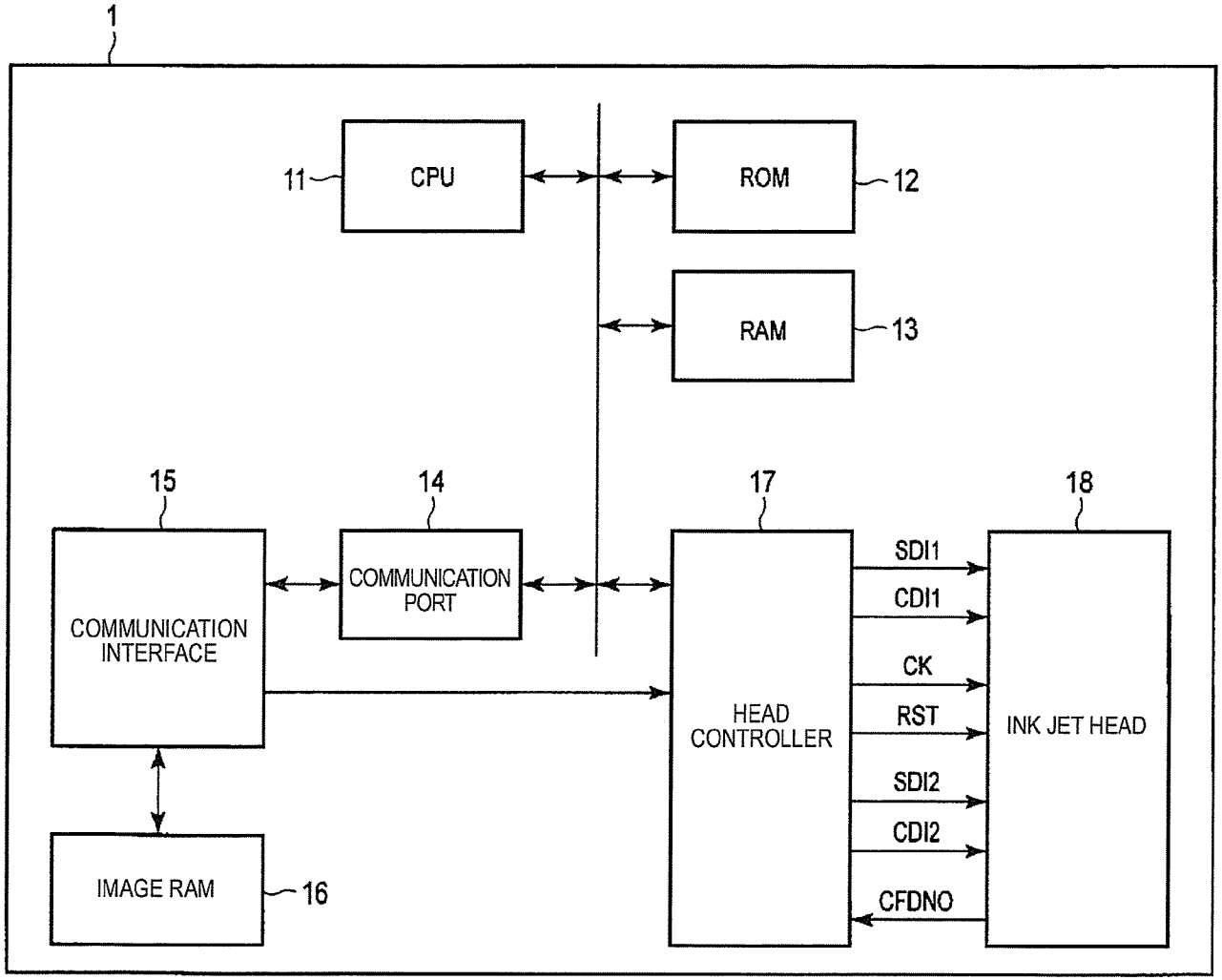
FIG. 1 is a block diagram illustrating a configuration example of an ink jet printer according to an embodiment.

FIG. 1 is a block diagram illustrating a configuration example of an ink jet printer 1 according to an embodiment. The inkjet printer 1 forms an image based on print data. For example, the ink jet printer 1 may obtain the print data from an external device such as a PC or may obtain the print data from a scanner and the like included in the ink jet printer 1.

The ink jet printer 1 may also form an image on a print medium such as a sheet that is set in the ink jet printer 1. Furthermore, the ink jet printer 1 may form the image on the print medium supplied from the outside. The print medium is the paper, vinyl, metal, or the like, but is not limited to a specific material or application.

As illustrated in FIG. 1, the ink jet printer 1 includes a CPU 11, a ROM 12, a RAM 13, a communication port 14, a communication interface 15, an image RAM 16, a head controller 17, an ink jet head 18, and the like.

The CPU 11 controls an entirety of the ink jet printer 1. The CPU 11 is a processor that implements processing by executing a program. The CPU 11 is connected to each section in the ink jet printer 1 through a system bus and the like. The CPU 11 outputs an operation instruction to each section in the ink jet printer 1 corresponding to an operation signal from the external device such as the PC or notifies the external device such as the PC of various types of information obtained from each section.

The ROM 12 is a non-rewritable nonvolatile memory that stores a program, control data, and the like. The RAM 13 is configured of a volatile memory. The RAM 13 functions as a working memory or a buffer memory. The CPU 11 implements various processes by executing a program stored in ROM 12 while using the RAM 13.

The communication port 14 is a port for connecting the communication interface 15 and the system bus.

The communication interface 15 (obtaining section) obtains print data. For example, the communication interface 15 is an interface for communicating with the external device such as the PC. That is, the communication interface 15 obtains the print data corresponding to a print request from the external device.

For example, the communication interface 15 may be locally connected to the external device or may be a network interface for communicating through a network. Furthermore, the communication interface 15 may perform wired communication or may perform wireless communication.

Furthermore, the communication interface 15 may obtain the print data from an internal device such as a scanner included in the ink jet printer 1.

The image RAM 16 is a volatile memory that stores the print data obtained from the external device such as the PC. The image RAM 16 may store the print data by the communication interface 15 or may store the print data by the CPU 11. Furthermore, the print data stored in the image RAM 16 may be transferred to the head controller 17 through the communication interface 15.

The head controller 17 drives the ink jet head 18 based on a signal from the CPU 11. The head controller 17 is electrically connected to a control circuit of the ink jet head 18. The head controller 17 transmits a print data packet, a setting data packet, a clock signal, a reset signal, and the like to the ink jet head 18 based on a signal from the CPU 11. Furthermore, the head controller 17 receives a setting statement from the ink jet head 18.

The head controller 17 is connected to the control circuit of the inkjet head 18 by using a print data line SDI that transfers the print data packet, a setting data line CDI that transfers the setting data packet, a clock signal data line CK that transfers the clock signal, a reset signal data line RST that transfers the reset signal, and a setting statement data line CFDNO that transfers the setting statement, and the like.

As described below, since having two control circuits, the head controller 17 is connected to the ink jet head 18 in two SDIs and two CDIs. For example, the head controller 17 transmits the print data packet and the setting data packet to two control circuits in serial transfer, respectively. Moreover, the head controller 17 may transmit the print data packet and the setting data packet to two control circuits in a cascade method.

The print data packet includes a start bit command and print data.

The setting data packet includes the start bit command and setting data.

The print data packet and the setting data packet will be described below.

The clock signal is a clock signal also serving for a system.

The reset signal resets the control circuit.

The ink jet head 18 discharges ink onto the print medium based on an instruction from the head controller 17. That is, the CPU 11 discharges ink from the ink jet head 18 through the head controller 17. The ink jet head 18 will be described below.

Moreover, the ink jet printer 1 may include an IO port and the like for transmitting and receiving a control signal to and from the external device. In addition, the ink jet printer 1 may further include another configuration such as a non-volatile memory and an operation panel as needed.

Next, the ink jet head 18 will be described.

Figure 2:
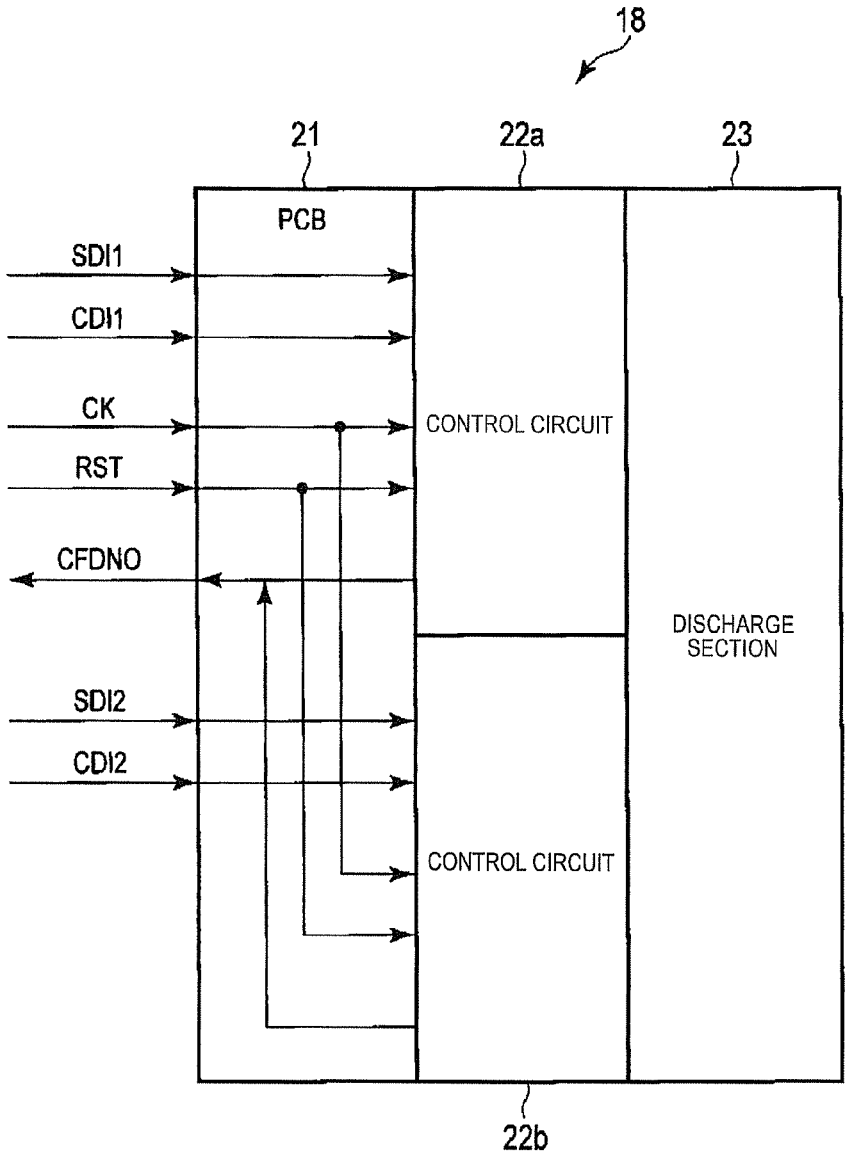
FIG. 2 is a block diagram illustrating a configuration example of an ink jet head according to the embodiment.

FIG. 2 is a block diagram illustrating a configuration example of the ink jet head 18.

As illustrated in FIG. 2, the ink jet head 18 includes a print circuit plate 21, control circuits 22*a* and 22*b*, and a discharge section 23. Here, the ink jet head 18 includes two control circuits 22*a* and 22*b*. The number of the control circuits included in the ink jet head 18 is not limited to a specific configuration.

The print circuit plate 21 inputs the print data packet, the setting data packet, the clock signal, the reset signal, and the like transmitted by the head controller 17 into the control circuits 22*a* and 22*b*.

The control circuits 22*a* and 22*b* control the discharge section 23 based on the print data packet, the setting data packet, the clock signal, the reset signal, and the like. The control circuits 22*a* and 22*b* apply a voltage to an actuator corresponding to each channel of the discharge section 23 and discharges ink from the discharge section 23.

A configuration example of the control circuits 22*a* and 22*b* will be described below.

The discharge section 23 discharges ink onto the print medium based on a signal and the like from the control circuits 22*a* and 22*b*. The discharge section 23 includes a pressure chamber formed by the actuator. The actuator changes a volume inside the pressure chamber by being expanded and contracted. For example, the actuator is formed of a piezoelectric element and the like.

The discharge section 23 discharges ink by an operation of the actuator. For example, in the discharge section 23, the pressure chamber is expanded and the pressure chamber is filled with ink by the operation of the actuator. Thereafter, the discharge section 23 discharges ink from nozzles communicating with the pressure chamber by using a force that is used for returning the size of the pressure chamber to the original size of the pressure chamber. Moreover, after the discharge section 23 discharges ink, the pressure chamber is contracted by the operation of the actuator and a vibration of the pressure chamber may be suppressed.

Next, the control circuits 22*a* and 22*b* will be described.

Figure 3:
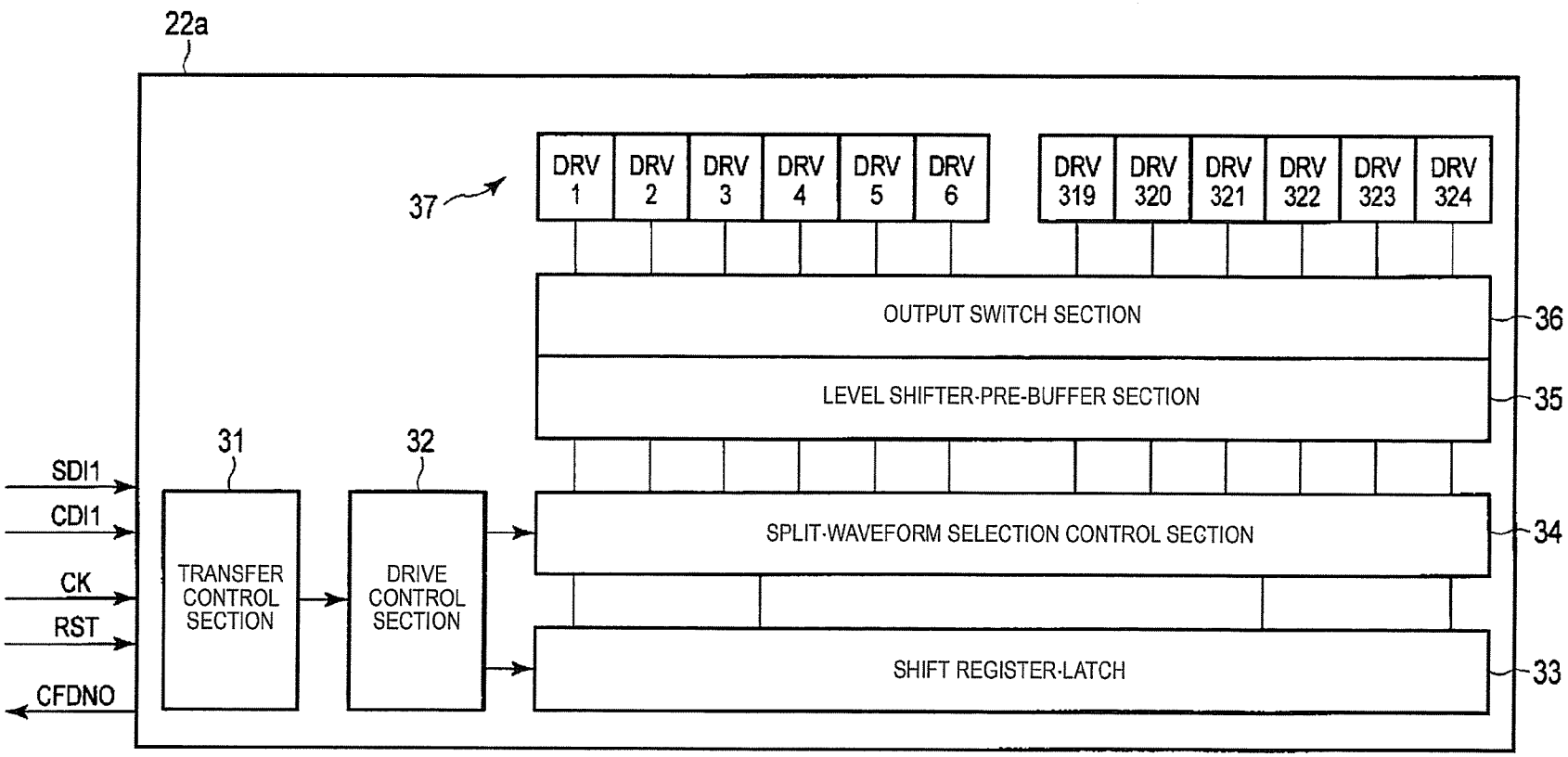
FIG. 3 is a block diagram illustrating a configuration example of a control circuit according to the embodiment.

FIG. 3 is a block diagram illustrating the configuration example of the control circuit 22*a* according to the embodiment. Moreover, since the control circuit 22*b* also has the same configuration as that of the control circuit 22*a*, the description of the control circuit 22*b* will be omitted.

As illustrated in FIG. 3, the control circuit 22*a* includes a transfer control section 31, a drive control section 32, a shift register•latch 33, a split•waveform selection control section 34, a level shifter•pre-buffer section 35, an output switch section 36, a driver group 37, and the like.

The transfer control section 31 performs operation setting of the control circuit 22*a* and the like based on the setting data from the head controller 17.

The transfer control section 31 performs start bit control, transfer control, setting control, command setting control, command control, and the like.

The start bit control receives a bit command (start bit command) indicating that transfer of the setting data or the print data is started in a state where an SDI line or a CDI line is normal. The start bit control detects start of transfer of the setting data or the print data by receiving the start bit command.

Furthermore, the start bit command indicates a command corresponding to the data that follows. In the embodiment, the start bit command is configured of "01" and a command code value indicating a command corresponding to the data. The command code value indicates a type of the command. The command code value will be described below in detail.

The transfer control transfers the print data from the head controller 17 to the shift register•latch 33.

The setting control performs other operation setting of the control circuit 22*a*.

The command setting control sets the command code value with respect to the command based on the setting data from the head controller 17. That is, the command setting control sets a unique command code value to each other with respect to each type of the command. The command setting control corresponds to "setting section" of the claims.

The command setting control stores the type of the command and the command code value in a setting register within the control circuit 22*a* by associating the type of the command and the command code value. The setting register will be described below.

The command control determines a command indicated by the command code value stored in the start bit command based on the command code value set by the command setting control. That is, the command control retrieves the command code value stored in the start bit command from the command code values set by the command setting control. The command control determines the command corresponding to the command code value that is retrieved as the command indicated by the command code value stored in the start bit command. The command control corresponds to the "determination section" of the claims.

The drive control section 32 controls the shift register•latch 33 and the split•waveform selection control section 34 based on setting of the transfer control section 31.

The drive control section 32 performs waveform generation control, split drive control, and the like.

The waveform generation control sets a waveform pattern of the voltage applied to the actuator of each channel of the discharge section 23 to the split•waveform selection control section 34. For example, the waveform generation control sets the waveform pattern corresponding to a channel discharging ink and a waveform pattern corresponding to a channel adjacent to the channel.

The split drive control sets the order in which the channel of the discharge section 23 is set to be a dischargeable group to the split•waveform selection control section 34. For example, the split drive control sets a channel of No. 3N to be the dischargeable group (discharge split channel group), thereafter, sets a channel of 3N+1 to be the discharge split channel group, and then sets a channel of No. 3N+2 to be the discharge split channel group.

The shift register•latch 33 sets the number of times or timing of discharging ink by each channel to the split•waveform selection control section 34 based on the print data.

The split•waveform selection control section 34 sets each channel of the discharge section 23 to be the group (the discharge split channel group) of the channel discharging ink and a group (adjacent split channel group) of a channel adjacent to the channel according to the order that is set by the drive control section 32.

Furthermore, the split•waveform selection control section 34 selects a pattern of the voltage applied to the actuator of each channel and transmits the selected pattern of the voltage to the level shifter•pre-buffer section 35 according to timing that is set by the shift register•latch 33.

The level shifter•pre-buffer section 35 generates a voltage necessary to drive each actuator of the discharge section 23. Moreover, the level shifter•pre-buffer section 35 may temporarily buffer the pattern of the voltage.

The output switch section 36 (voltage application section) applies a voltage generated by the level shifter•pre-buffer section 35 to the driver group 37 based on the pattern of the voltage transmitted from the split•waveform selection control section 34. That is, the output switch section 36 applies the voltage to the actuator of the channel of the discharge section 23 based on the command determined by the command control.

For example, the output switch section 36 applies the voltage generated by the level shifter•pre-buffer section 35 to a driver corresponding to the channel in a period in which a pattern of a voltage corresponding to a certain channel indicates High. Furthermore, the output switch section 36 applies the voltage generated by the level shifter•pre-buffer section 35 to the driver by being inverted in a period in which the pattern of the voltage indicates Low.

The driver group 37 includes a plurality of drivers corresponding to the channels of the discharge section 23. Each driver of the driver group 37 applies the voltage applied by the output switch section 36 to the actuator of the corresponding channel.

Next, a configuration example of the setting register that is used for the command setting control by the transfer control section 31 will be described.

FIG. 4 is a diagram illustrating the configuration example of the setting register.

As illustrated in FIG. 4, the setting register includes storage regions from R1 to R255. In the embodiment, the storage regions from R1 to R6 are command value setting areas. Furthermore, the storage regions from R7 to R255 are generated waveform setting areas.

The storage regions from R1 to R6 store the command code value corresponding to the type of the command.

Here, the type of the command includes a command-in, a first line, a printing•initial, printing, a heat•initial, and heat.

"Command-in" starts setting based on the following setting data.

"First line" indicates that transfer of the print data is started.

"Printing•initial" indicates timing when an initial split channel group capable of discharging ink discharges ink.

"Printing" indicates timing when the next split channel group capable of discharging ink discharges ink.

"Heat•initial" indicates timing when the initial split channel group starts a heat operation. The heat operation is an operation of the actuator to heat the pressure chamber.

"Heat" indicates timing when the next split channel group starts the heat operation.

"Setting value" indicates the command code value corresponding to the type of the command. The "setting value" is set by the setting data. That is, the setting register stores the command code value corresponding to the type of the command as the "setting value" based on the setting data transmitted by the head controller 17 before a discharge operation. For example, the setting register stores "11" as the "setting value" corresponding to the "command-in". In this case, the control circuit 22 recognizes that the following setting data is transmitted when receiving "0111" as the start bit command. For "setting value", any value may be set with respect to the type of the command.

The "initial value" is a command code value set in advance before the command code value is set based on the setting data. Here, the setting register stores the "initial value" corresponding to the "command-in". The "command-in" is a command that is used when receiving the setting data. Thus, the setting register cannot store the "setting value" corresponding to the "command-in" by the setting data. Thus, the setting register stores the "initial value" corresponding to the "command-in" in advance.

Moreover, the setting register may store the "initial value" corresponding to a type of another command.

The storage regions from R6 to R255 store data necessary for generating the pattern of the voltage.

Next, the setting data packet transmitting the setting data will be described.

Figure 5:
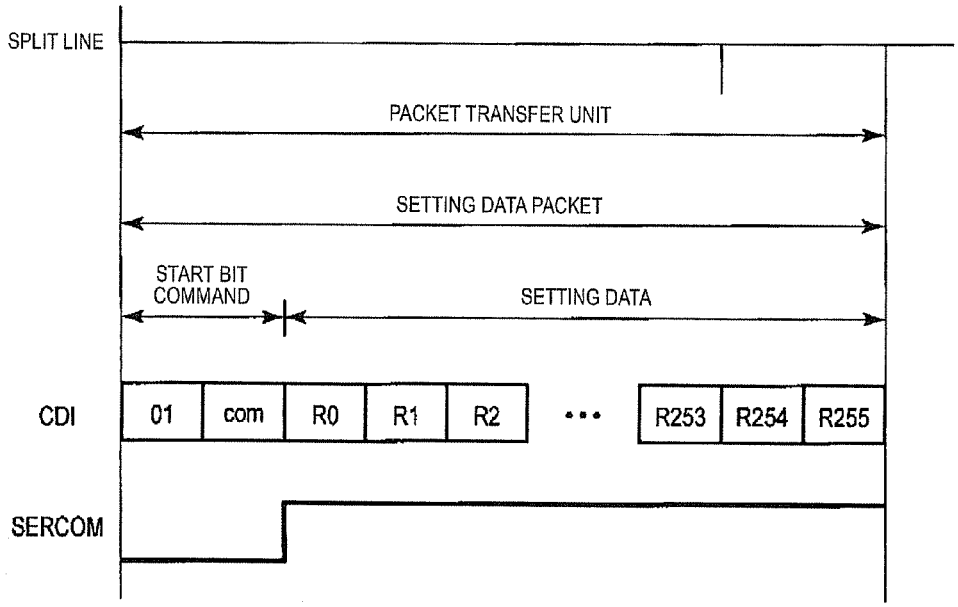
FIG. 5 is an example of a timing chart when the control circuit according to the embodiment receives a setting data packet.

FIG. 5 is a timing chart illustrating an example of the setting data packet transmitting the setting data.

The "split line" indicates a time when the split channel group discharges ink. That is, the split channel group ends the discharge operation of ink during a time from a split line to the next split line.

"SERCOM" is an enable signal of the setting data. That is, "SERCOM" becomes "High" when the setting data is transmitted.

The CDI transmits the start bit command and the setting data following the start bit command as the setting data packet.

The start bit command includes "01" and the "com" following "01".

The "com" is a data bit indicating the type of the command. That is, the "com" is the data bit that is created by encoding the command code value indicating the type of the command. Since the following data is the setting data, the "com" indicates the "command-in".

The setting data includes data stored from R0 to R255 in the setting register. That is, the setting data stores the "setting value" corresponding to each type of the command and data that is used for generating the waveform. The setting data may be stored in a state where each data is encoded.

The setting data is transmitted from the head controller 17 before the discharge operation. The setting data may be transmitted for each print operation or may be re-transmitted during the print operation.

Moreover, the setting data may be transmitted over a plurality of packets.

Next, the print data packet (command data) transmitting the print data will be described.

Figure 6:
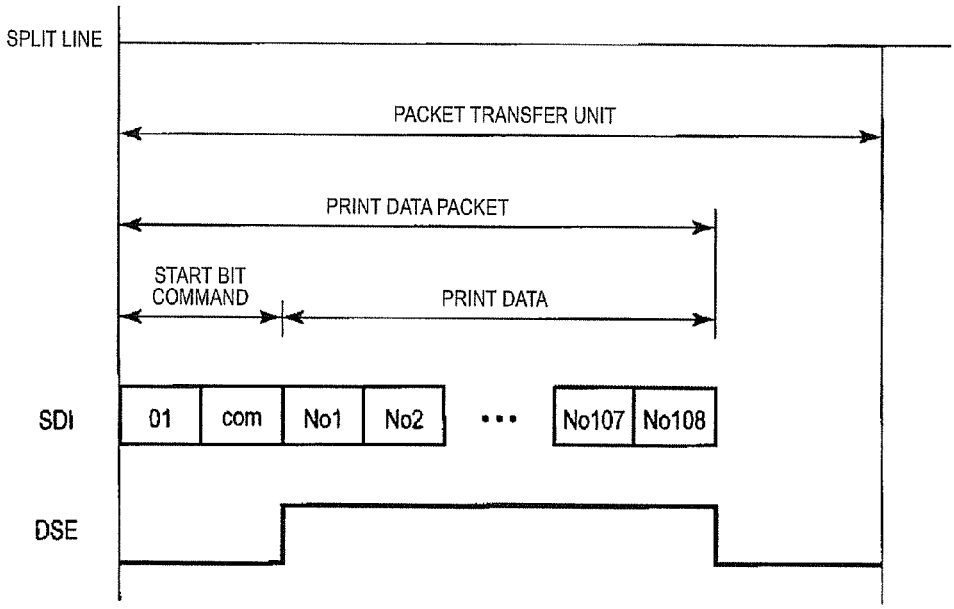
FIG. 6 is an example of a timing chart when the control circuit according to the embodiment receives a print data packet.

FIG. 6 is a timing chart illustrating an example of the print data packet transmitting the print data.

"Split line" is the same as that of FIG. 5.

"DSE" is the enable signal of the print data. That is, "DSE" becomes "High" when the print data is transmitted.

SDI transmits the start bit command and the print data following the start bit command as the print data packet.

The start bit control includes "01" and the "com". The "com" is the data bit that is created by encoding the command code value indicating the type of the command. For example, the "com" is "first line", "printing•initial", "printing", "heat•initial", the "heat", and the like.

The print data indicates the number or timing of discharging ink by the channel of the discharge section 23. The print data may be a 0/1 signal indicating the presence or absence of discharge of ink or may be a code indicating the number of discharging.

The print data is configured of a plurality of discharge data indicating the number or timing of discharging ink by each channel. Here, the print data includes the discharge data corresponding to the channels from No. 1 to No. 108. The plurality of discharge data stored in the print data corresponds to each channel of the dischargeable split channel group.

The print data stored in the print data packet is the print data corresponding to the following split channel group of the split channel group in which the start bit command of the print data packet designates the discharge timing. That is, the control circuit 22 applies the voltage to the actuator of each channel according to the print data stored in a previous print data packet when receiving the start bit command of the print data packet.

Next, an operation example of the control circuit 22 will be described.

Here, the setting register is assumed not to store the "setting value".

Figure 7:
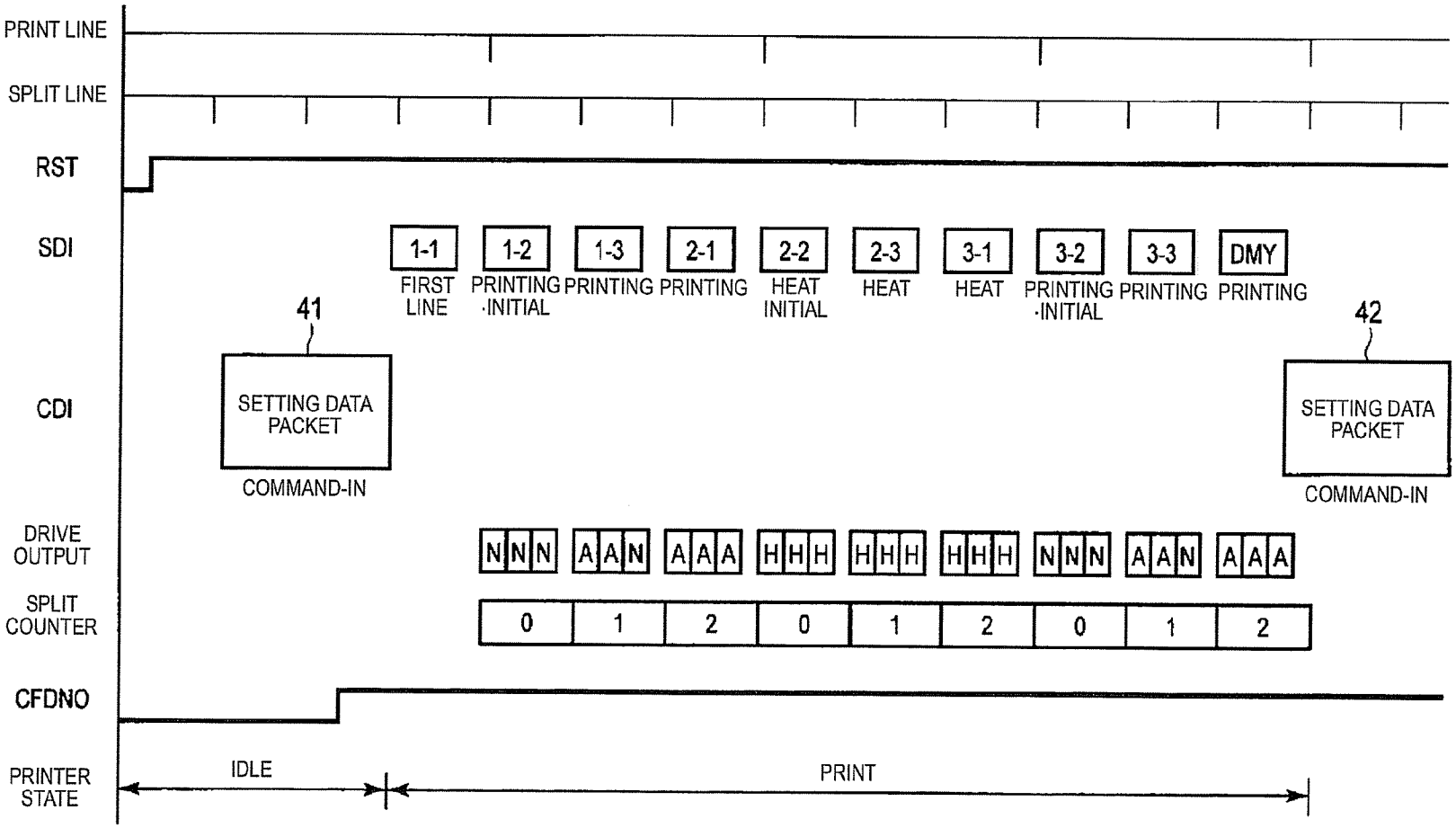
FIG. 7 is an example of a timing chart of data that is transmitted and received by the control circuit according to the embodiment.

FIG. 7 illustrates an example of a timing chart of data that is transmitted and received by the control circuit 22.

"Print line" is a time when three split channel groups end the discharge of ink. That is, the control circuit 22 discharges ink in order from the three split channel groups between the "print lines".

"Split line" is the same as the above description.

"RST" indicates the reset signal supplied to the control circuit 22. Here, if the reset signal is Low, the control circuit 22 resets.

"Drive output" indicates the pattern of the voltage applied to the actuator of a specific dischargeable channel. "N" indicates that the pattern of the voltage in which ink is not discharged is applied. "A" indicates that the pattern of the voltage in which ink is discharged is applied. "H" indicates that the pattern of the voltage in which the actuator is heated is applied.

"Split counter" indicates the dischargeable split channel group. For example, "0" indicates the split channel group of the channel of No. 3N. Furthermore, "1" indicates the split channel group of the channel of No. 3N+1. "2" indicates the split channel group of the channel of 3N+2.

The channel indicated in the "drive output" varies depending on the corresponding the "split counter". For example, the "drive output" corresponding to "0" of the "split counter" indicates the pattern of the voltage applied to the actuator of any cannel in No. 3N.

"CFDNO" indicates the setting statement transmitted to a CFDNO line.

"Printer state" indicates a print state of the ink jet printer. "Idle" indicates that the ink jet printer does not perform the discharge operation of ink. "Print" indicates that the ink jet printer performs the discharge operation of ink.

First, the control circuit 22 receives a setting data packet 41 from the head controller 17 through the CDI line. This operation of the control circuit 22 corresponds to the first receiving section of the claims.

If the setting data packet 41 is received, the control circuit 22 decodes the "com" within the start bit command. Since the setting data is transmitted after the start bit, the "com" indicates the "command-in". Furthermore, here, the "com" indicates "01" that is the "initial value" of the command-in.

If the "com" is decoded, the control circuit 22 operates according to the command indicated by the decoded data. Here, the control circuit 22 performs operation setting according to the setting data following the start bit command. That is, the control circuit 22 stores data including the setting data to each register corresponding to the setting register as the command setting control (operation of the setting section). The setting register stores the "setting value" corresponding to the type of the command by this operation.

If the setting data is stored in the setting register, the control circuit 22 waits until the print data packet is received.

The control circuit 22 receives a print data packet 1-1 from the head controller 17 through the SDI. This operation of the control circuit 22 corresponds to the second receiving section of claim 1.

If the print data packet 1-1 is received, the control circuit 22 decodes the "com" within the start bit command of the print data packet 1-1. If the "com" is decoded, the control circuit 22 determines the command indicated by the "com" by the command control (operation of the determination section). Here, the "com" within the start bit command of the print data packet 1-1 indicates the first line as the command. Furthermore, the print data of the print data packet 1-1 is the print data corresponding to the split channel group (split channel group indicated by "0") capable of initially discharging.

The control circuit 22 receives a print data packet 1-2 after the print data packet 1-1. If the print data packet 1-2 is received, the control circuit 22 decodes the "com" within the start bit command of the print data packet 1-2. If the "com" is decoded, the control circuit 22 determines the command indicated by the "com" by the command control (operation of the determination section). Here, the "com" within the start bit command of the print data packet 1-2 indicates the printing•initial. Thus, the control circuit 22 applies the voltage that discharges ink with respect to each actuator of the split channel group capable of initially discharging according to the print data stored in the print data packet 1-1. That is, the control circuit 22 discharges ink to the initial split channel group (split channel group indicated by "0").

Furthermore, the print data of the print data packet 1-2 is the print data corresponding to the split channel group (the split channel group indicated by "1") capable of next discharging.

If ink is discharged from the initial split channel group, the control circuit 22 receives a print data packet 1-3. If the print data packet 1-3 is received, the control circuit 22 decodes the "com" within the start bit command of the print data packet 1-3. If the "com" is decoded, the control circuit 22 determines the command indicated by the "com" by the command control (operation of the determination section). Here, the "com" within the start bit command of the print data packet 1-3 indicates printing. Thus, the control circuit 22 applies the voltage discharging ink with respect to each actuator of the split channel group capable of next discharging according to the print data stored in the print data packet 1-2. That is, the control circuit 22 discharges ink to the next split channel group (split channel group indicated by "1").

Furthermore, the print data of the print data packet 1-3 is the print data corresponding to the split channel group (split channel group indicated by "2") capable of next discharging.

If ink is discharged from the next split channel group, the control circuit 22 receives a print data packet 2-1. If the print data packet 2-1 is received, the control circuit 22 decodes the "com" within the start bit command of the print data packet 2-1. If the "com" is decoded, the control circuit 22 determines the command indicated by the "com" by the command control (operation of the determination section). Here, the "com" within the start bit command of the print data packet 2-1 indicates printing. Thus, the control circuit 22 applies the voltage discharging ink with respect to each actuator of the split channel group capable of next discharging according to the print data stored in the print data packet 1-3. That is, the control circuit 22 discharges ink to the next split channel group (split channel group indicated by "2").

Furthermore, the print data packet 2-1 may not store the print data.

If ink is discharged from the next split channel group, the control circuit 22 receives a print data packet 2-2. If the print data packet 2-2 is received, the control circuit 22 decodes the "com" within the start bit command of the print data packet 2-2. If the "com" is decoded, the control circuit 22 determines the command indicated by the "com" by the command control (operation of the determination section). Here, the "com" within the start bit command of the print data packet 2-2 indicates the heat•initial. Thus, the control circuit 22 applies the voltage heating the actuator with respect to each actuator of the initial split channel group. That is, the control circuit 22 heats the actuator of the initial split channel group (split channel group indicated by "0").

In addition, the print data packet 2-2 may not store the print data.

If the actuator is heated in the initial split channel group, the control circuit 22 receives a print data packet 2-3. If the print data packet 2-3 is received, the control circuit 22 decodes the "com" within the start bit command of the print data packet 2-3. If the "com" is decoded, the control circuit 22 determines the command indicated by the "com" by the command control (operation of the determination section). Here, the "com" within the start bit command of the print data packet 2-3 indicates the heat. Thus, the control circuit 22 applies the voltage heating the actuator with respect to each actuator of the next split channel group. That is, the control circuit 22 heats the actuator of the initial split channel group (split channel group indicated by "1").

In addition, the print data packet 2-3 may not store the print data.

If the actuator is heated in the next split channel group, the control circuit 22 receives a print data packet 3-1. If the print data packet 3-1 is received, the control circuit 22 decodes the "com" within the start bit command of the print data packet 3-1. If the "com" is decoded, the control circuit 22 determines the command indicated by the "com" by the command control (operation of the determination section). Here, the "com" within the start bit command of the print data packet 3-1 indicates the heat. Thus, the control circuit 22 applies the voltage heating the actuator with respect to each actuator of the next split channel group. That is, the control circuit 22 heats the actuator of the initial split channel group (split channel group indicated by "2").

In addition, the print data of the print data packet 3-1 is the print data corresponding to the split channel group (split channel group indicated by "0") capable of initially discharging.

If the actuator is heated in the next split channel group, the control circuit 22 receives a print data packet 3-2. If the print data packet 3-2 is received, the control circuit 22 decodes the "com" within the start bit command of the print data packet 3-2. If the "com" is decoded, the control circuit 22 determines the command indicated by the "com" by the command control (operation of the determination section). Here, the "com" within the start bit command of the print data packet 3-2 indicates the printing•initial. Thus, the control circuit 22 applies the voltage discharging ink with respect to each actuator of the split channel group capable of initially discharging according to the print data stored in the print data packet 3-1. That is, the control circuit 22 discharges ink to the initial split channel group (the split channel group indicated by "0").

Furthermore, the print data of the print data packet 3-2 is the print data corresponding to the split channel group (split channel group indicated by "1") capable of next discharging.

If ink is discharged from the initial split channel group, the control circuit 22 receives a print data packet 3-3. If the print data packet 3-3 is received, the control circuit 22 decodes the "com" within the start bit command of the print data packet 3-3. If the "com" is decoded, the control circuit 22 determines the command indicated by the "com" by the command control (operation of the determination section). Here, the "com" within the start bit command of the print data packet 3-3 indicates printing. Thus, the control circuit 22 applies the voltage discharging ink with respect to each actuator of the split channel group capable of next discharging according to the print data stored in the print data packet 3-2. That is, the control circuit 22 discharges ink to the next split channel group (split channel group indicated by "1").

In addition, the print data of the print data packet 3-3 is the print data corresponding to the split channel group (split channel group indicated by "2") capable of next discharging.

If ink is discharged from the next split channel group, the control circuit 22 receives a dummy print data packet. Since the head controller 17 designates timing when the last discharge operation is started, the dummy print data packet is transmitted. If the dummy print data packet is received, the control circuit 22 decodes the "com" within the start bit command of the dummy print data packet. If the "com" is decoded, the control circuit 22 determines the command indicated by the "com" by the command control (operation of the determination section). Here, the "com" within the start bit command of the dummy print data packet indicates printing. Thus, the control circuit 22 applies the voltage discharging ink with respect to each actuator of the split channel group capable of next discharging according to the print data stored in the print data packet 3-3. That is, the control circuit 22 discharges ink to the next split channel group (split channel group indicated by "2").

If ink is discharged to the next split channel group, the control circuit 22 waits for the next setting data packet 42.

The control circuit 22 receives the setting data packet 42. If the setting data packet 42 is received, the control circuit 22 performs the same operation.

The control circuit 22 discharges ink to the print medium such as a sheet and forms an image such as letters on the print medium by repeating the operation described above.

The inkjet head having the configuration described above can set a different command code value for each operation with respect to the same command.

Several embodiments of the invention are described, but the embodiments are presented as examples and are not intended to limit the scope of the invention. The novel embodiments described herein may be implemented in other various forms and omissions, substitutions, and changes can be performed without departing from the scope of the invention. These embodiments or their modifications are included in the scope or the gist of the invention, and the invention as set forth in the appended claims, and its equivalents of the invention.

What is claimed is:

1. An ink jet head comprising:

a discharge section that discharges ink by an operation of an actuator;

a control section that has a register, a first receiving section that receives setting data including a first command code value corresponding to a command, a setting section that stores the first command code value in the register, a second receiving section that receives a print data packet including a second command code value and print data, and a determination section that determines to apply the command to print in accordance with the print data if the second command code value is identical to the first command code value stored in the register; and a voltage applying section that applies a voltage to the actuator of the discharge section based on the command that is determined by the determination section.

2. The ink jet head according to claim 1, wherein the print data packet includes a start bit command having the second command code value.

3. The ink jet head according to claim 1, wherein the print data includes the number of times or timing of discharging ink by the discharge section.

4. An ink jet printer comprising:

an ink jet head which has an actuator to discharge ink by applying a voltage to the actuator;

an obtaining section that obtains print data;

a control section that has a register, a first receiving section that receives setting data including a command code value corresponding to a command, a setting section that stores the first command code value in the register, a second receiving section that receives a print data packet including a second command code value and the print data, and a determination section that determines to apply the command to print in accordance with the print data if the second command code value is identical to the first command code value stored in the register; and a voltage applying section that applies the voltage to the actuator based on the command that is determined by the determination section.

5. The ink jet printer according to claim 4, wherein the print data packet includes a start bit command having the second command code value.

6. The ink jet printer according to claim 4, wherein the print data includes the number of times or timing of discharging ink by the discharge section.

* * * * *